US007045958B2

(12) United States Patent
Ramamoorthi et al.

(10) Patent No.: US 7,045,958 B2
(45) Date of Patent: May 16, 2006

(54) VACUUM DEVICE HAVING A GETTER

(75) Inventors: Sriram Ramamoorthi, Corvallis, OR (US); Zhizhang Chen, Corvallis, OR (US); John Liebeskind, Corvallis, OR (US); Ronald L. Enck, Corvallis, OR (US); Jennifer Shih, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 234 days.

(21) Appl. No.: 10/413,048

(22) Filed: Apr. 14, 2003

(65) Prior Publication Data

US 2004/0201349 A1 Oct. 14, 2004

(51) Int. Cl.

*H01J 17/24* (2006.01)
*H01J 19/70* (2006.01)
*H01J 61/26* (2006.01)

(52) U.S. Cl. ..... 313/553; 313/559; 313/549; 313/560; 313/558

(58) Field of Classification Search ..... 313/547, 313/495–497, 561, 422, 554, 553; 417/49, 417/51; 218/131

See application file for complete search history.

(56) References Cited

U.S. PATENT DOCUMENTS

| | | | | |
|---|---|---|---|---|
| 4,571,158 | A | 2/1986 | Maegdefessel | |
| 4,710,344 | A | 12/1987 | Ward et al. | |
| 5,223,766 | A | 6/1993 | Nakayama | |
| 5,293,511 | A | 3/1994 | Poradish et al. | |
| 5,453,659 | A | 9/1995 | Wallace et al. | |
| 5,485,019 | A | 1/1996 | Yamazaki | |
| 5,610,438 | A | 3/1997 | Wallace et al. | |
| 5,614,785 | A | 3/1997 | Wallace | |
| 5,701,008 | A | 12/1997 | Ray et al. | |
| 5,729,086 | A * | 3/1998 | Jeong et al. | 313/495 |
| 5,772,404 | A * | 6/1998 | Carella et al. | 417/51 |
| 5,934,964 | A | 8/1999 | Carella et al. | |
| 5,964,630 | A | 10/1999 | Slusarczuk | |
| 6,008,576 | A * | 12/1999 | Nakatani et al. | 313/495 |
| 6,042,443 | A | 3/2000 | Carella et al. | |
| 6,057,636 | A * | 5/2000 | Sakai et al. | 313/306 |
| 6,111,354 | A * | 8/2000 | Fink et al. | 313/495 |
| 6,127,777 | A | 10/2000 | Watkins et al. | |
| 6,139,390 | A | 10/2000 | Pothoven et al. | |
| 6,194,830 | B1 * | 2/2001 | Cho et al. | 313/553 |
| 6,396,207 | B1 * | 5/2002 | Hasegawa et al. | 313/495 |
| 6,486,610 | B1 * | 11/2002 | Kojima et al. | 315/169.3 |
| 6,787,982 | B1 * | 9/2004 | Ryu et al. | 313/493 |
| 6,838,822 | B1 * | 1/2005 | Yonezawa et al. | 313/562 |

FOREIGN PATENT DOCUMENTS

| | | | |
|---|---|---|---|
| EP | 1273645 A1 * | 1/2003 | |
| WO | WO01/80273 A1 | 10/2001 | |

* cited by examiner

*Primary Examiner*—Mariceli Santiago

(57) ABSTRACT

A vacuum device, including a substrate and a support structure having a support perimeter, where the support structure is disposed over the substrate. In addition, the vacuum device also includes a non-evaporable getter layer having an exposed surface area. The non-evaporable getter layer is disposed over the support structure, and extends beyond the support perimeter, in at least one direction, of the support structure forming a vacuum gap between the substrate and the non-evaporable getter layer increasing the exposed surface area.

40 Claims, 9 Drawing Sheets

VACUUM DEVICE HAVING A GETTER

BACKGROUND

DESCRIPTION OF THE ART

The ability to maintain a low pressure or vacuum for a prolonged period in a microelectronic package is increasingly being sought in such diverse areas as displays technologies, micro-electro-mechanical systems (MEMS) and high density storage devices. For example, computers, displays, and personal digital assistants may all incorporate such devices. Many vacuum packaged devices utilize electrons to traverse some gap to excite a phosphor in the case of displays, or to modify a media to create bits in the case of storage devices, for example.

One of the major problems with vacuum packaging of electronic devices is the continuous outgassing of hydrogen, water vapor, carbon monoxide, and other components found in ambient air, and from the internal components of the electronic device. Typically, to minimize the effects of outgassing one uses gas-absorbing materials commonly referred to as getter materials. Generally a separate cartridge, ribbon, or pill incorporates the getter material that is then inserted into the electronic vacuum package. In addition, in order to maintain a low pressure, over the lifetime of the vacuum device, a sufficient amount of getter material must be contained within the cartridge or cartridges, before the cartridge or cartridges are sealed within the vacuum package.

Providing an auxiliary compartment situated outside the main compartment is one alternative others have taken. The auxiliary compartment is connected to the main compartment such that the two compartments reach largely the same steady-state pressure. Although this approach provides an alternative to inserting a ribbon or cartridge inside the vacuum package, it still results in the undesired effect of producing either a thicker or a larger package. Such an approach leads to increased complexity and difficulty in assembly as well as increased package size. Especially for small electronic devices with narrow gaps, the incorporation of a separate cartridge also results in a bulkier package, which is undesirable in many applications. Further, the utilization of a separate compartment increases the cost of manufacturing because it is a separate part that requires accurate positioning, mounting, and securing to another component part to prevent it from coming loose and potentially damaging the device.

Depositing the getter material on a surface other than the actual device such as a package surface is another alternative approach taken by others. For example, a uniform vacuum can be produced by creating a uniform distribution of pores through the substrate of the device along with a uniform distribution of getter material deposited on a surface of the package. Although this approach provides an efficient means of obtaining a uniform vacuum within the vacuum package, it also will typically result in the undesired effect of producing a thicker package, because of the need to maintain a reasonable gap between the bottom surface of the substrate and the top surface of the getter material to allow for reasonable pumping action. In addition, yields typically decrease due to the additional processing steps necessary to produce the uniform distribution of pores.

If these problems persist, the continued growth and advancements in the use electronic devices, in various electronic products, seen over the past several decades, will be reduced. In areas like consumer electronics, the demand for cheaper, smaller, more reliable, higher performance electronics constantly puts pressure on improving and optimizing performance of ever more complex and integrated devices. The ability, to optimize the gettering performance of non-evaporable getters may open up a wide variety of applications that are currently either impractical, or are not cost effective. As the demands for smaller and lower cost electronic devices continues to grow, the demand to minimize both the die size and the package size will continue to increase as well.

DESCRIPTION OF THE PREFERRED EMBODIMENTS

Figure 1A:
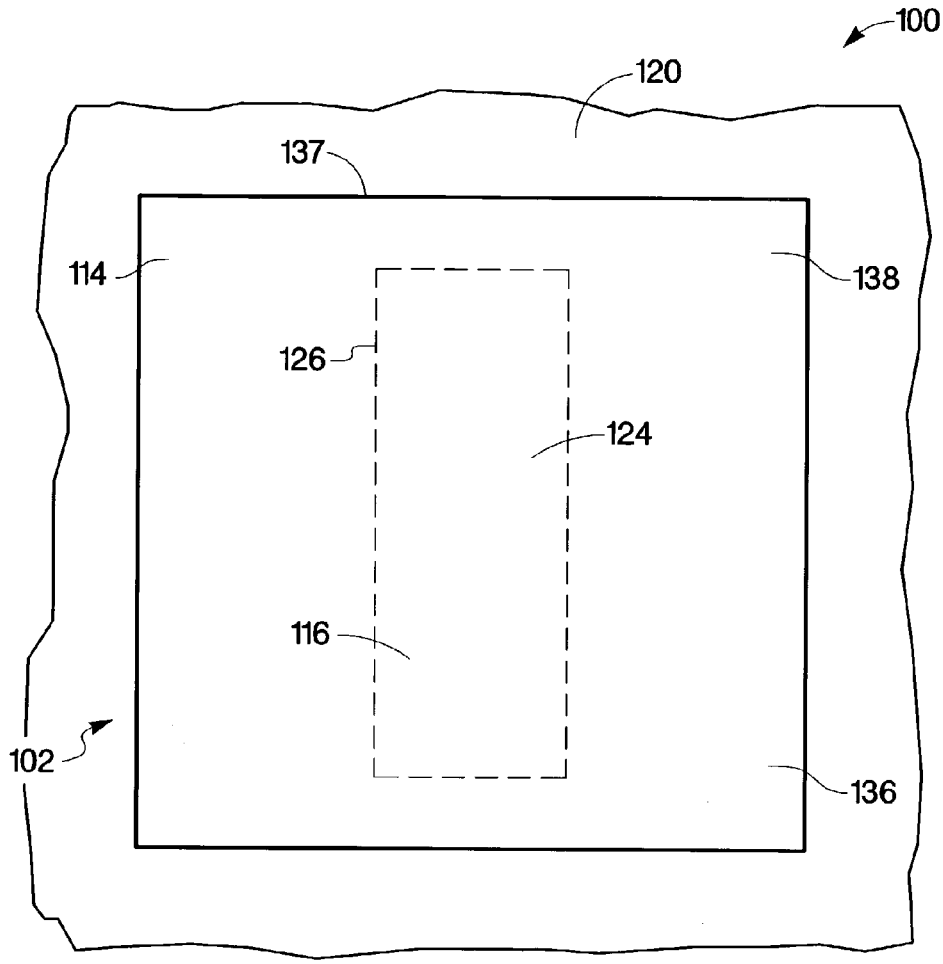
FIG. 1*a* is a top view of a getter structure according to an embodiment of the present invention.

Referring to FIG. 1*a*, an embodiment of vacuum device 100 of the present invention, in a top view, is shown. Getter structure 102 is utilized as a vacuum pump to maintain a vacuum or pressure below atmospheric pressure for vacuum device 100. Vacuum device 100 may be incorporated into any device utilizing a vacuum, such as, electronic devices, MEMS devices, mechanical devices, and optical devices to name a few. As electronic manufacturers look for higher orders of integration to reduce product costs, typically, package sizes get smaller leaving less room for getter material. Electronic circuits and devices disposed on a wafer or substrate limit the area available for getter structures. This limited area increases the desire to fabricate getters with high surface area structures having a small footprint on the substrate or wafer. In addition, in those embodiments utilizing wafer-level packaging, a technique that is becoming more popular for its low costs, placing a higher surface area getter structure directly on the wafer, both simplifies the fabrication process, as well as lowers costs.

Figure 1B:
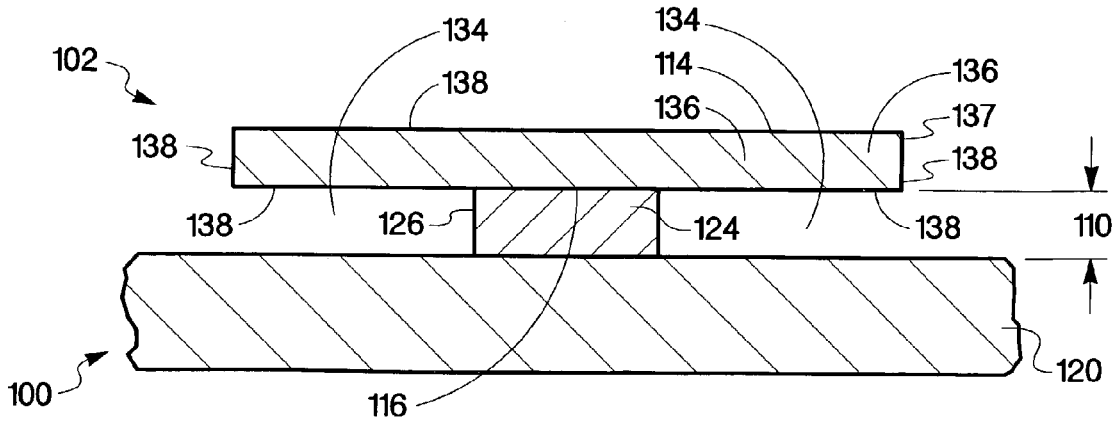
FIG. 1*b* is a cross-sectional view of the getter structure shown in FIG. 1*a* according to an embodiment of the present invention.

In this embodiment, getter structure 102 includes support structure 124 disposed on substrate 120 and non-evaporable getter layer 136 (hereinafter NEG layer 136), is disposed on support structure 124. NEG layer 136 also includes exposed surface area 138. Support structure 124, in this embodiment, has support perimeter 126, having a rectangular shape, that is smaller than NEG layer perimeter 137 creating support undercut region 134 as shown, in a cross-sectional view, in FIG. 1*b*. In alternate embodiments, support perimeter 126 may also utilize shapes such as square, circular, polygonal or other shapes. In addition, NEG layer perimeter 137 may also utilize various shapes. Further, support structure 124, in this embodiment, is centered under NEG layer 136, however, in alternate embodiments, support structure 124 may be located toward one edge or at an angle such as at one set of corners of a diagonal to a rectangular or square shaped NEG layer, for example. NEG layer 136, by extending beyond support perimeter 126, increases exposed surface area 138 of NEG layer 136 and generates vacuum gap 110, as shown in FIG. 1*b*. Vacuum gap 110 provides a path for gas molecules or particles to impinge upon the bottom or the substrate facing surface of NEG layer 136, thus increasing the exposed surface area available for pumping residual gas particles providing an increase in the effective pumping speed of getter structure 102. Vacuum gap 110, in this embodiment, is about 2.0 micrometers, however, in alternate embodiments vacuum gap 110 may range from about 0.1 micrometer to about 20 micrometers. In still other embodiments, vacuum gap 110 may range up to 40 micrometers wide. Support structure 124, in this embodiment, has a thickness of about 2.0 micrometers, however, in alternate embodiments, thicknesses in the range from about 0.1 micrometers to about 20 micrometers also may be utilized. In still other embodiments, thicknesses up to about 40 micrometers may be utilized.

The surface area and volume of the NEG material included in NEG layer 136 determines the getter pumping speed and capacity respectively of getter structure 102. Still referring to FIGS. 1*a*–1*b* the increase in pumping speed of getter structure 102 also may be illustrated by examining the relationship between the getter layer area 114 (i.e. $A_g$) and support area 116 (i.e. $A_s$). For a single NEG layer, deposited directly on the substrate, an effective surface area for pumping of $A_g$ plus the perimeter or edge surface area is provided. Whereas by inserting support structure 124 between NEG layer 136 and substrate 120, and ignoring, or assuming constancy of, the edge surface area we have an effective surface area for pumping of $A_g$ (for the top surface) plus $(A_g-A_s)$ (for the bottom surface) or combining the two we find $2A_g-A_s$. For example, if $A_s$ is one fourth the area of NEG layer 136 then we have increased the effective surface area for pumping by 1.75 over a single layer deposited on the substrate assuming that the layer thickness and thus edge surface area is constant between the two different structures.

Examples of getter materials that may be utilized include titanium, zirconium, thorium, molybdenum and combinations of these materials. In this embodiment, the getter material is a zirconium-based alloy such as Zr—Al, Zr—V, Zr—V—Ti, or Zr—V—Fe alloys. However, in alternate embodiments, any material having sufficient gettering capacity for the particular application in which vacuum device 100 will be utilized also may be used. NEG layer 136 is applied, in this embodiment, using conventional sputtering or vapor deposition equipment, however, in alternate embodiments, other deposition techniques such as electroplating, or laser activated deposition also may be utilized. In this embodiment, NEG layer 136 has a thickness of about 2.0 micrometers, however, in alternate embodiments, thicknesses in the range from about 0.1 micrometers to about 10 micrometers also may be utilized. In still other embodiments, thicknesses up to about 20 micrometers may be utilized. Support structure 124, in this embodiment, is formed from a silicon oxide layer, however, in alternate embodiments, any material that will either not be severely degraded or damaged during activation of the NEG material in NEG layer 126 also may be utilized. For example, support structure 124 may be formed from various metal oxides, carbides, nitrides, or borides. Other examples include forming support structure 124 from metals including NEG materials, which has the advantage of further increasing the pumping speed and capacity of getter structure 102. Substrate 120, in this embodiment, is silicon, however, any substrate suitable for forming electronic devices, such as gallium arsenide, indium phosphide, polyimides, and glass as just a few examples also may be utilized.

It should be noted that the drawings are not true to scale. Further, various elements have not been drawn to scale. Certain dimensions have been exaggerated in relation to other dimensions in order to provide a clearer illustration and understanding of the present invention.

In addition, although some of the embodiments illustrated herein are shown in two dimensional views with various regions having depth and width, it should be clearly understood that these regions are illustrations of only a portion of a device that is actually a three dimensional structure. Accordingly, these regions will have three dimensions, including length, width, and depth, when fabricated on an actual device. Moreover, while the present invention is illustrated by various embodiments, it is not intended that these illustrations be a limitation on the scope or applicability of the present invention. Further it is not intended that the embodiments of the present invention be limited to the physical structures illustrated. These structures are included to demonstrate the utility and application of the present invention.

Figure 2:
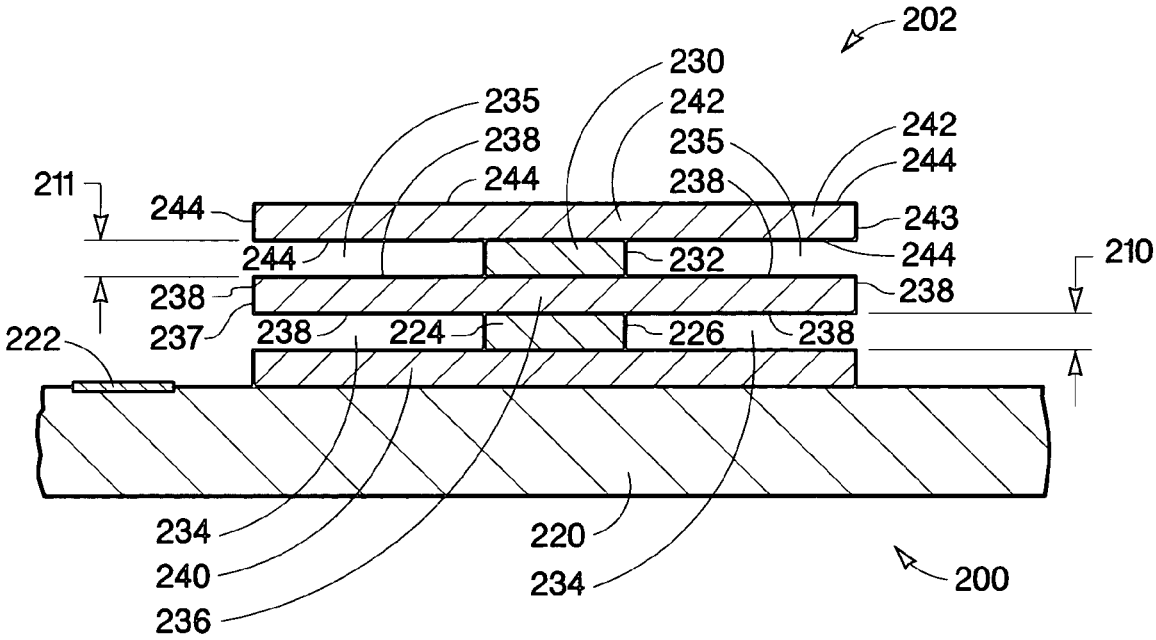
FIG. 2 is a cross-sectional view of a getter structure according to an alternate embodiment of the present invention.

Referring to FIG. 2, an alternate embodiment of vacuum device 200 of the present invention is shown in a cross-sectional view. In this embodiment, getter structure 202 includes base NEG layer 240 disposed on substrate 220 and second NEG layer 242 providing additional pumping speed and capacity as compared to a single layer structure shown in FIGS. 1*a*–1*b*. Support structure 224 has support perimeter 226 and is disposed on base NEG layer 240, second support structure 230 has second support perimeter 232 and is disposed on NEG layer 236. Second NEG layer 242 is disposed on second support structure 230.

In this embodiment, both support perimeter 226 and second support perimeter 232 have the same size perimeter, however, in alternate embodiments, both perimeters may have different perimeter sizes as well as shapes and thicknesses. Further, support perimeter 226 is smaller than NEG layer perimeter 237 creating support undercut region 234 and second support perimeter 232 is smaller than second NEG layer perimeter 243 creating second support undercut region 235. As noted above in FIG. 1*a* the particular placement, size, and shape of the support structures may be varied, as well as different from each other. NEG layers 236 and 242 by extending beyond support perimeters 226 and 232, increase exposed surface areas 238 and 244 generating vacuum gaps 210 and 211.

As noted above, for the embodiment shown in FIGS. 1*a* and 1*b*, vacuum gaps 210 and 211 provide paths for gas molecules or particles to impinge upon the bottom or the substrate facing surfaces of the NEG layers increasing the exposed surface area available for pumping residual gas particles. Utilizing the same type of analysis as described above, and ignoring base NEG layer 240 for a moment; for a multi-layered getter structure, as illustrated in FIG. 2, assuming all NEG layers have the same area, all the support structures have the same area, and N represents the number of NEG layers we find the effective surface area for pumping is increased by $A_g+(N+1)(A_g-A_s)$. Thus again assuming $A_s$ is one fourth the area of the NEG layers, as an example, we have increased the effective surface area for pumping by $3.25\times A_g$ over a single layer deposited on the substrate assuming that the layer thickness and thus edge surface areas are constant between the two structures. If we now take into account base NEG layer 240 we find the effective surface area for pumping is increased by $A_g+(N+2)(A_g-A_s)$. Thus, for the structure depicted in FIG. 2 assuming, again, $A_s$ is one fourth the area of the NEG layers, as an example, we have increased the effective surface area for pumping by $4.00\times A_g$ over a single layer deposited on the substrate assuming that the layer thicknesses and thus edge surface areas are constant between the two structures.

Still referring to FIG. 2 vacuum device 200 also includes logic devices 222 formed on substrate 220. Logic devices 222 are represented as only a single layer in FIG. 2 to simplify the drawing. Those skilled in the art will appreciate that logic devices 222 can be realized as a stack of thin film layers. In this embodiment, logic devices may be any type of solid state electronic device, such as, transistors or diodes as just a couple of examples of devices that can be utilized in an electronic device. In alternate embodiments, other devices also may be utilized either separately or in combination with the logic devices, such as sensors, vacuum devices or passive components such as capacitors and resistors. In addition, in alternate embodiments, by utilizing a capping layer or planarization layer disposed over logic devices 222, getter structure 202 also may be disposed over logic devices 222. Substrate 220, in this embodiment, is manufactured using a silicon wafer having a thickness of about 300–700 microns. Using conventional semiconductor processing equipment, the logic devices are formed on substrate 220. Although, substrate 220 is silicon, other materials also may be utilized, such as, for example, various glasses, aluminum oxide, polyimide, silicon carbide, and gallium arsenide. Accordingly, the present invention is not intended to be limited to those devices fabricated in silicon semiconductor materials, but will include those devices fabricated in one or more of the available semiconductor materials and technologies known in the art, such as thin-film-transistor (TFT) technology using, for example, polysilicon on glass substrates.

Figure 3:
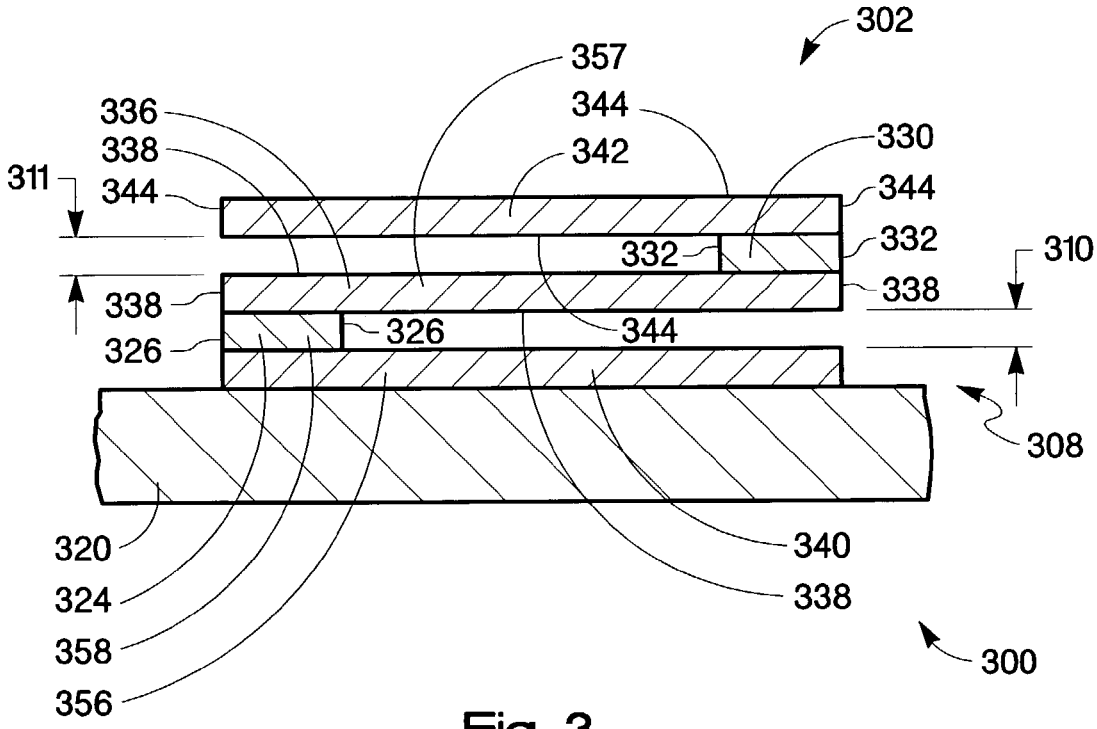
FIG. 3 is a cross-sectional view of a getter structure according to an alternate embodiment of the present invention.

Referring to FIG. 3, an alternate embodiment of vacuum device 300 of the present invention is shown, in a cross-sectional view. In this embodiment, getter structure 302 includes base NEG layer 340, support structure 324 and NEG layer 336 disposed to form folded structure 308 having at least one fold. Base NEG layer 340 is disposed on substrate 320 and support structure 324 is disposed at one edge on base NEG layer 340. Support structure 324 includes support perimeter 326 and second support structure 330 has second support perimeter 332. Second support structure 330 is disposed at an opposing edge on NEG layer 336. Second NEG layer 342 is disposed with one edge of second NEG layer on second support structure 330. Base NEG layer 340 forms first section 356 and NEG layer 336 forms second section 357 and are substantially parallel to each other. Support structure 324 forms folding section 358 with the three sections 356–358 forming a U shaped structure. NEG layers 336 and 342 by extending beyond support perimeters 326 and 332, increase exposed surface areas 338 and 344 generating vacuum gaps 310 and 311 and increasing the effective pumping speed of getter structure 302 as discussed in the previous embodiments.

Figure 4:
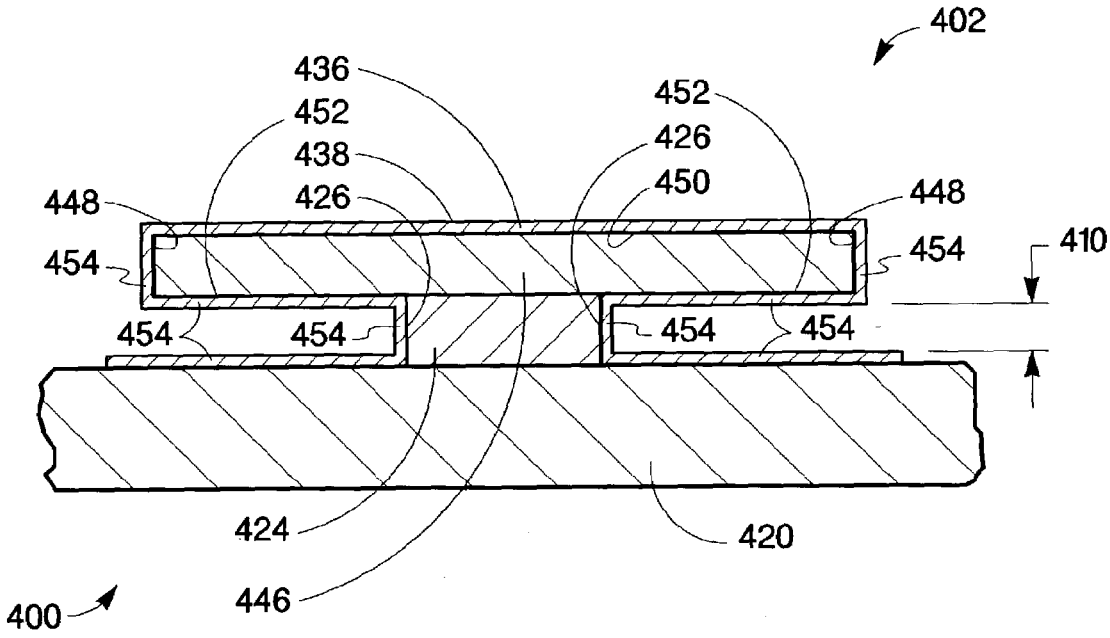
FIG. 4 is a cross-sectional view of a getter structure according to an alternate embodiment of the present invention.

Referring to FIG. 4, an alternate embodiment of vacuum device 400 of the present invention is shown in a cross-sectional view. In this embodiment, getter structure 402 includes support structure 424 disposed on substrate 420 and core layer 446 disposed on support structure 424 with NEG layer 436 disposed on top surface 450 of core layer 446. In addition, support structure 424 and core layer 450 have support perimeter 426 and core layer perimeter 448 respectively, where core layer 448 extends beyond support perimeter 426 and core layer perimeter 448 is larger than support perimeter 426. Thus, in this embodiment, NEG material 454 is formed on or deposited on core layer perimeter surface 448, exposed bottom surface 452 of core layer 446, support perimeter surface 426, and on the surface of substrate 420 substantially enclosing or conformally coating core layer 446 and support structure 424 with NEG material. In this embodiment, NEG layer 436 and NEG material 454 are deposited directly on the core layer, support surface, and the substrate surface. However, in alternate embodiments, a barrier layer may be deposited onto these surfaces or a particular surface to reduce any interaction, such as a chemical reaction, between the NEG material and the surface onto which it is deposited. And in still other embodiments, the barrier layer may include multiple layers. Core layer 446 by extending beyond support perimeter 426, increases exposed surface area 438 of NEG material 454 and generates vacuum gap 410. Only one core layer is shown in this embodiment, however, in alternate embodiments, multiple core layers and support structures also may be utilized to further increase the effective pumping speed of getter structure 402 as discussed above.

In this embodiment, NEG material 454 and NEG layer 436 are the same material, however, in alternate embodiments, NEG layer 436 may be formed from a material different than NEG material 454. NEG layer 436 may be formed utilizing a wide variety of deposition techniques. NEG material 454 may be formed or deposited using a variety of techniques such as ionized physical vapor deposition (PVD), glancing or low angle sputter deposition, chemical vapor deposition, electroplating. In this embodiment, support structure 424 is formed from a polysilicon layer, and core layer 448 is a silicon oxide ($SiO_x$) film. In alternate embodiments, the support structure may be formed from a silicon dioxide layer and the core layer formed from a silicon nitride layer. In still other embodiments, both the support structure and core layer may be formed utilizing a metal such as titanium, zirconium, thorium, molydenum tantalum, tungsten, gold and combinations of these materials. In still further embodiments, any material that will not be severely degraded or damaged during activation of the NEG material also may be utilized. In addition, the support structure and core layer also may be formed from the same material.

Figure 5A:
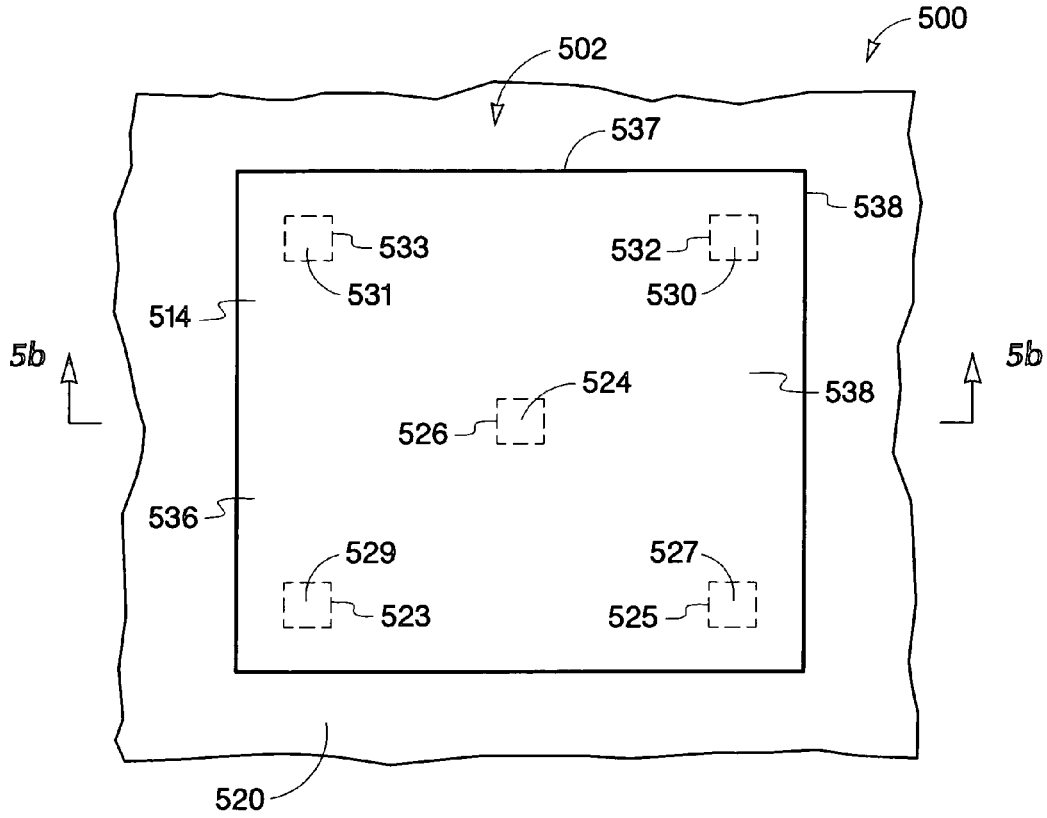
FIG. 5*a* is a top view of a getter structure disposed on a vacuum device according to an alternate embodiment of the present invention.
Figure 5B:
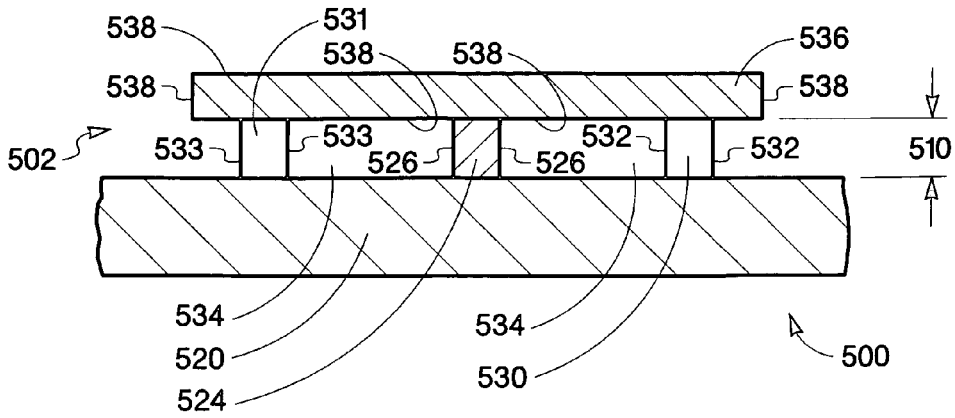
FIG. 5*b* is a cross-sectional view of the getter structure shown in FIG. 5*a* according to an alternate embodiment of the present invention.

Referring to FIGS. 5*a*–5*b*, an alternate embodiment of vacuum device 500 of the present invention is shown in a cross-sectional view. In this embodiment, getter structure 502 includes multiple support structures 524, 527, 529, 530, and 531 disposed on substrate 520 are utilized to support NEG layer 536. Support structures 524, 527, 529, 530, and 531 include support perimeters 526, 525, 523, 532, and 533 respectively. Support structures 524, 527, 529, 530, and 531, in this embodiment, have a square shape, and disposed within NEG layer perimeter 537 creating support undercut region 534 as shown in a cross-sectional view in FIG. 5*b*. In alternate embodiments, the support structures may also utilize other shapes such as rectangular, circular, or polygonal as well as being disposed in other spatial arrangements. For example, getter structure 520 may utilize four support structures positioned at each corner, or NEG layer perimeter 537 may be circular in form and three rectangular support structures, emanating radial, and placed 120 degrees apart also may be utilized. In addition, NIEG layer perimeter 537 may also utilize other simple and complex shapes. Support structures 524, 527, 529, 530, and 531, in forming support undercut region 534, increase exposed surface area 538 of NEG layer 536 and generate vacuum gap 510, as shown in FIG. 5*b*. Vacuum gap 510 provides a path for gas molecules or particles to impinge upon the bottom or the substrate facing surface of NEG layer 536, thus increasing the exposed surface area of getter layer area 514 available for pumping residual gas particles thereby increasing the effective pumping speed of getter structure 502.

Figure 6A:
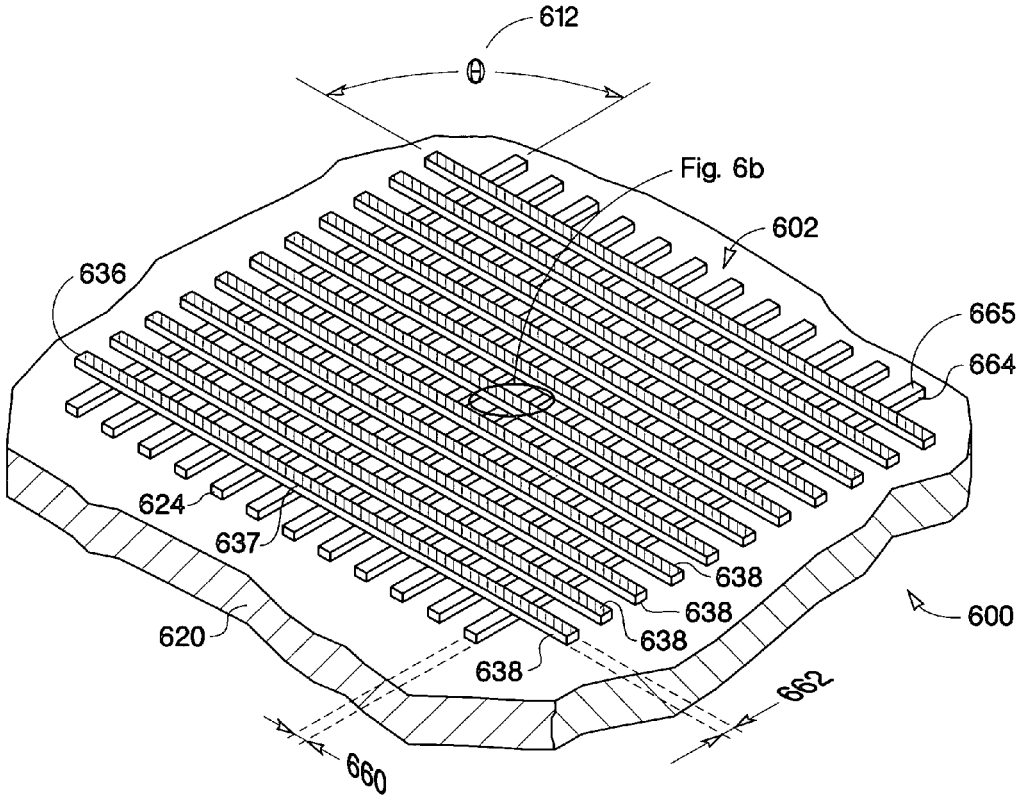
FIG. 6*a* is a perspective view of a crossbar getter structure according to an alternate embodiment of the present invention.
Figure 6B:
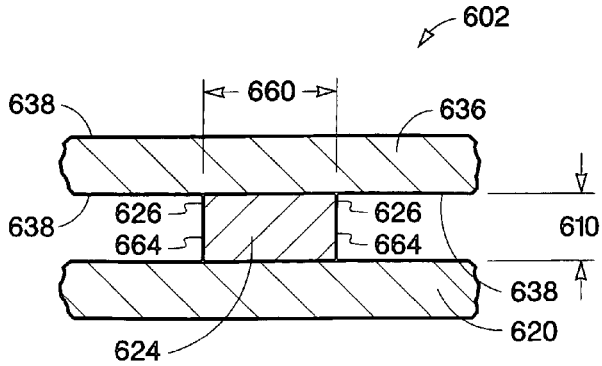
FIG. 6*b* is a cross-sectional view of one of the elements of the crossbar getter structure shown in FIG. 6*a* according to an alternate embodiment of the present invention.

Referring to FIGS. 6*a*–6*b*, an alternate embodiment of vacuum device 600 of the present invention is shown in a perspective view. In this embodiment, getter structure 602 includes a plurality of NEG lines 636 disposed on a plurality of support structure lines 624 forming a crossbar getter structure. Support structure lines 624 are formed of a non-evaporable getter material and are substantially parallel to each other. NEG lines 636 are also substantially parallel to each other and are disposed at predetermined angle 612 to support structure lines 624. Support structure lines 624 are disposed on substrate 620 and have a length and width 660 forming support structure line perimeter 626. Support structure lines 624 also include exposed support line side surfaces 664 and between NEG lines 636 exposed support line top surfaces 665. In addition, NEG lines 636 also have a length and width 662 forming NEG line perimeter 637. In this embodiment, NEG lines 636 extend beyond support structure line width 660 increasing exposed surface area 638 of NEG lines 636 and generates vacuum gap 610, as shown in FIG. 6*b*. In this embodiment, vacuum gap 610 as well as the gaps or openings between both the NEG lines and the support lines provide a path for gas molecules or particles to impinge upon the exposed surface of both NEG lines 636 and support structure lines 524, thus increasing the exposed surface area available for pumping residual gas particles increasing the effective pumping speed of getter structure 602.

Figure 6C:
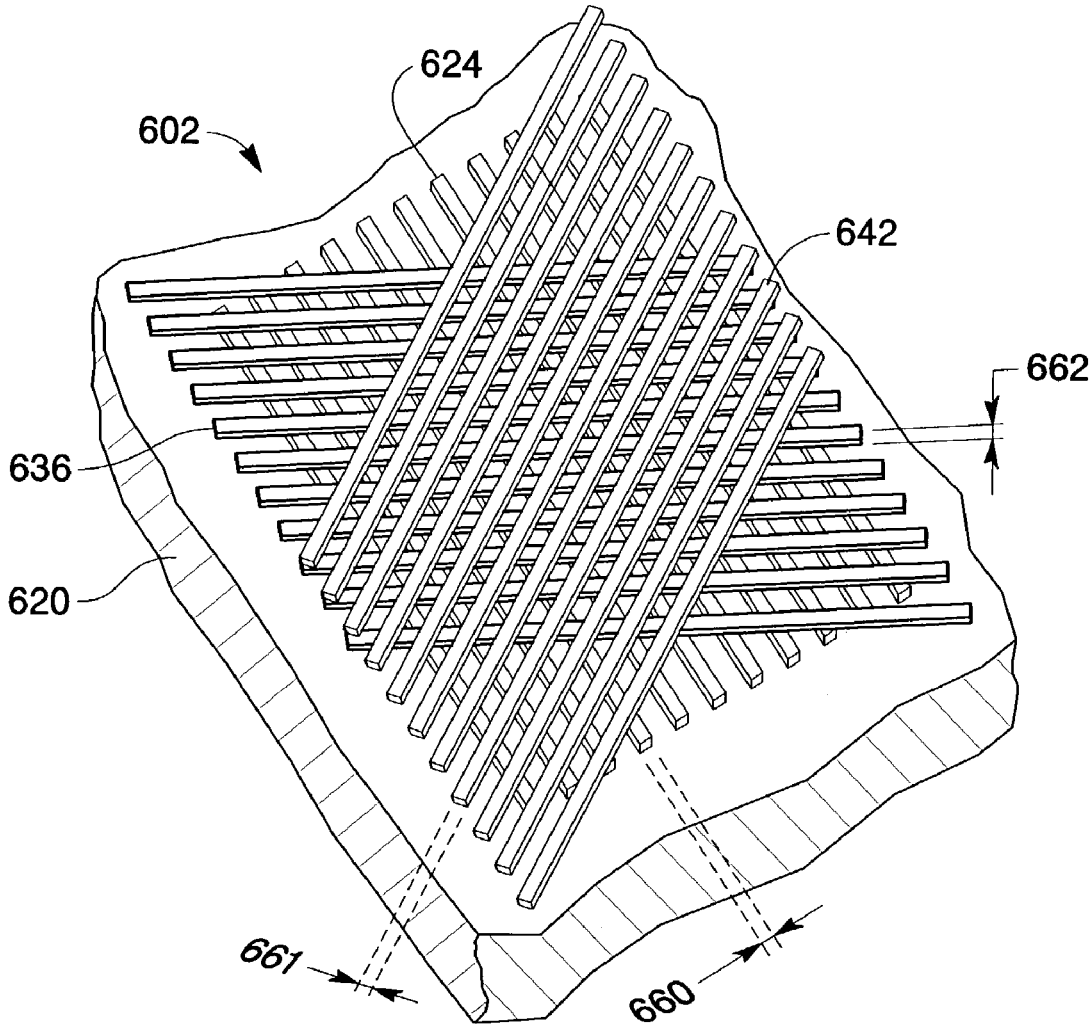
FIG. 6*c* is a perspective view of a crossbar getter structure according to an alternate embodiment of the present invention.
Figure 7:
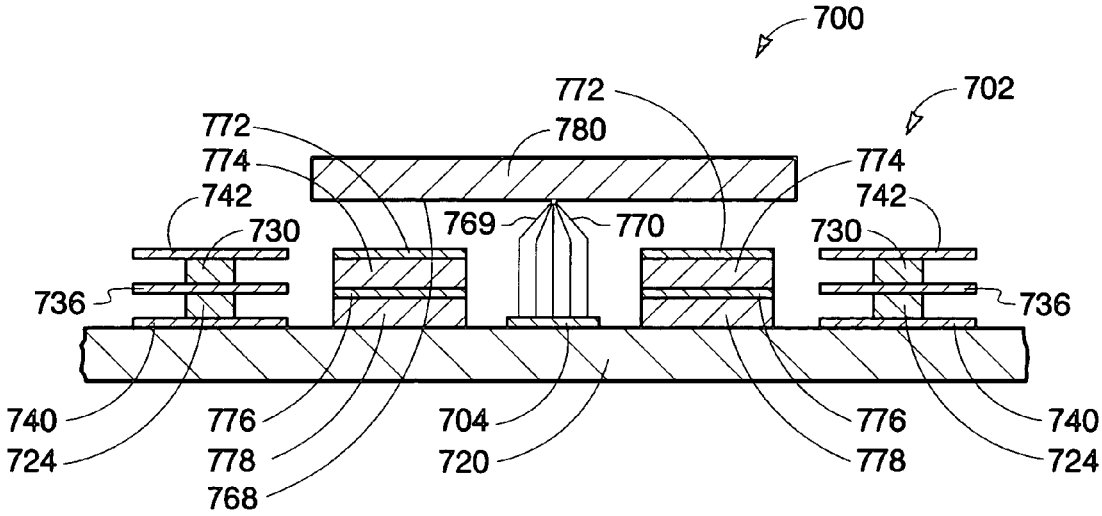
FIG. 7 is cross-sectional view of an electronic device having an integrated vacuum device according to an alternate embodiment of the present invention.

Referring to FIG. 6*c*, an alternate embodiment of vacuum device 600 of the present invention is shown, in a perspective view. In this embodiment, getter structure 602' includes a plurality of NEG lines 636 disposed on a plurality of support structure lines 624 and a plurality of second NIEG lines 642 disposed on NEG lines 636 forming a hexagonal array of NEG lines. In this embodiment, support structure lines 624. NEG lines 636 and second NIEG lines 642 each have a length and each have a width 660', 662' and 661' respectively. Support structure lines 624 are formed of a non-evaporable getter material and are substantially parallel to each other. NEG lines 636 and second NEG lines 642 are also substantially parallel to each other. In alternate embodiments, the lines may be disposed at a predetermined angle other than 60 degrees. In this embodiment, the vacuum gaps formed between the lines in both a vertical and a horizontal direction provide a path for gas molecules or particles to impinge upon the exposed surface of NEG material, thus increasing the exposed surface area available for pumping residual gas particles increasing the effective pumping speed of getter structure 602'. In still other embodiments, additional lines of NEG material may be formed further increasing the effective pumping speed of the getter structure.

An exemplary embodiment of electronic device 700 having integrated vacuum device 704 that includes anode surface 768 such as a display screen or a mass storage device that is affected by electrons 769 when they are formed into a focused beam 770. Anode surface 768 is held at a predetermined distance from second electron lens element 772. Getter structure 702, in this embodiment, includes base NEG layer 740 disposed on substrate 720, and NEG layer 736 and second NEG layer 742 with support structure 724 and second support structure 730 separating the NEG layers. In alternate embodiments getter structure 702 may utilize any of the embodiments described above. Electronic device 700 is enclosed in a vacuum package (not shown). The vacuum package includes a cover and a vacuum seal formed between the cover and substrate 720. In this embodiment anode surface 768 may form a portion of the cover, however, in alternate embodiments a cover separate from anode 768 also may be utilized. The vacuum seal, the cover and the substrate form a vacuum or interspace region, and the vacuum package encloses getter structure 702.

In this embodiment, integrated vacuum device 704 is shown in a simplified block form and may be any of the electron emitter structures well known in the art such as a Spindt tip or flat emitter structure. Second lens element 772 acts as a ground shield. Vacuum device 704 is disposed over at least a portion of device substrate 720. First insulating or dielectric layer 774 electrically isolates second lens element 772 from first lens element 776. Second insulating layer 778 electrically isolates first lens element 776 from vacuum device 704 and substrate 720. In alternate embodiments, more than two lens elements, also may be utilized to provide, for example, an increased intensity of emitted electrons 769, or an increased focusing of electron beam 770, or both. Utilizing conventional semiconductor processing equipment both the lens elements and dielectrics may be fabricated. In still other embodiments first and second lens elements may be formed utilizing a NEG material, and a portion of first and second insulating layers may be etched away and utilized as support structures to form additional getter structures.

As a display screen, an array of pixels (not shown) are formed on anode surface 768, which are typically arranged in a red, blue, green order, however, the array of pixels also may be a monochromatic color. An array of emitters (not shown) are formed on device substrate 720 where each element of the emitter array has one or more integrated vacuum devices acting as an electron emitter. Application of the appropriate signals to an electron lens structure including first and second electron lens elements 772 and 776 generates the necessary field gradient to focus electrons 769 emitted from vacuum device 704 and generate focused beam 770 on anode surface 768.

As a mass storage device, anode surface 768 typically includes a phase-change material or storage medium that is affected by the energy of focused beam 770. The phase-change material generally is able to change from a crystalline to an amorphous state (not shown) by using a high power level of focused beam 770 and rapidly decreasing the power level of focused beam 770. The phase-change material is able to change from an amorphous state to a crystalline state (not shown) by using a high power level of focused beam 770 and slowly decreasing the power level so that the media surface has time to anneal to the crystalline state. This change in phase is utilized to form a storage area on anode surface 768 that may be in one of a plurality of states depending on the power level used of focused beam 770. These different states represent information stored in that storage area.

An exemplary material for the phase change media is germanium telluride (GeTe) and ternary alloys based on GeTe. The mass storage device also contains electronic circuitry (not shown) to move anode surface 768 in a first and preferably second direction relative to focused beam 770 to allow a single integrated vacuum device 704 to read and write multiple locations on anode surface 768. To read the data stored on anode or media surface 768, a lower-energy focused beam 770 strikes media surface 768 that causes electrons to flow through the media substrate 780 and a reader circuit (not shown) detects them. The amount of current detected is dependent on the state, amorphous or crystalline, of the media surface struck by focused beam 770.

Figure 8:
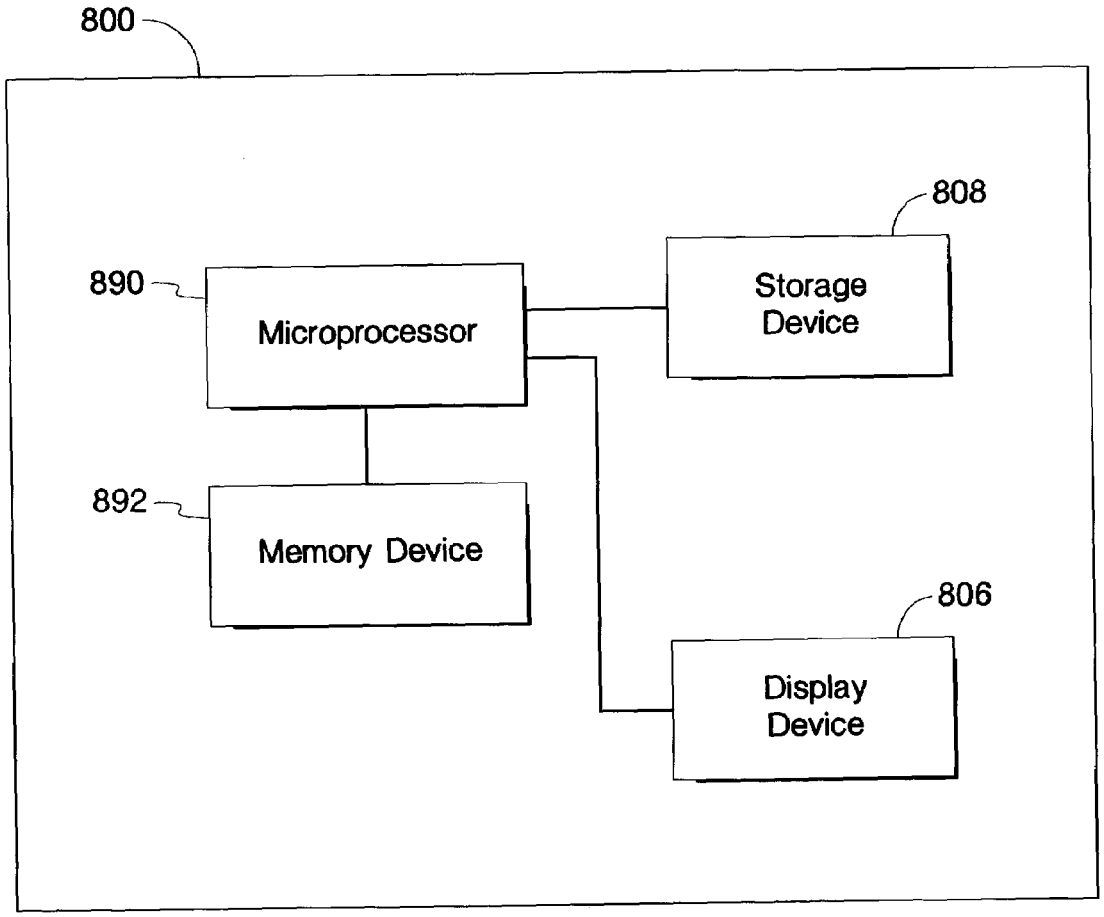
FIG. 8 is a block diagram of an electronic device according to an alternate embodiment of the present invention.

Referring to FIG. 8 an exemplary block diagram of an electronic device 800, such as a computer system, video game, Internet appliance, terminal, MP3 player, cellular phone, or personal digital assistant to name just a few is shown. Electronic device 800 includes microprocessor 890, such as an Intel processor sold under the name "Pentium Processor," or compatible processor. Many other processors exist and also may be utilized. Microprocessor 890 is electrically coupled to a memory device 892 that includes processor readable memory that is capable of holding computer executable commands or instructions used by the microprocessor 890 to control data, input/output functions, or both. Memory device 892 may also store data that is manipulated by microprocessor 890. Microprocessor 890 is also electrically coupled either to storage device 808, or display device 806 or both. Microprocessor 890, memory device 892, storage device 808, and display device 806 each may contain an embodiment of the present invention as exemplified in earlier described figures and text showing vacuum devices having a getter structure.

The invention claimed is:

1. A vacuum device, comprising:

a substrate;

a support structure having a support perimeter defined by support sidewalls of said support structure, said support structure disposed over said substrate; and a non-evaporable getter layer having an exposed surface area and a getter perimeter defined by getter sidewalls of said non-evaporable getter layer, said non-evaporable getter layer disposed on and in cohesive contact with said support structure within said support perimeter, and extending beyond said support perimeter in at least one direction of said support structure forming a vacuum gap between said substrate and said non-evaporable getter layer, increasing said exposed surface area, wherein said support perimeter is substantially within said getter perimeter.

2. The vacuum device in accordance with claim 1, further comprising a base non-evaporable getter layer interposed between said support structure and said substrate.

3. The vacuum device in accordance with claim 1, further comprising:

a second support structure having a second perimeter, said second support structure disposed over said non-evaporable getter layer; and a second non-evaporable getter layer having a second exposed surface area, said second non-evaporable getter layer disposed over said second support structure, and extending beyond said second perimeter of said second support structure forming a second vacuum gap between said non-evaporable getter layer and said second non-evaporable getter layer.

4. The vacuum device in accordance with claim 1, wherein said support structure, said non-evaporable getter layer, and a second non-evaporable getter layer form a folded structure having at least one fold.

5. The vacuum device in accordance with claim 4, wherein said folded structure further comprises a first section, a second section, and a folding section, wherein said second section is folded back and substantially parallel to said first section, whereby a U shaped structure is formed.

6. The vacuum device in accordance with claim 5, wherein said first section is substantially parallel to said substrate.

7. The vacuum device in accordance with claim 1, wherein said support structure includes a non-evaporable getter material.

8. The vacuum device in accordance with claim 1, wherein said vacuum gap is in the range from about 0.1 micrometer to about 20 micrometers.

9. The vacuum device in accordance with claim 1, wherein said vacuum gap is up to about 40 micrometers wide.

10. The vacuum device in accordance with claim 1, wherein said support structure has a thickness in the range from about 0.1 micrometer to about 20 micrometers.

11. The vacuum device in accordance with claim 1, wherein said support structure has a thickness of up to about 40 micrometers.

12. The vacuum device in accordance with claim 1, wherein said non-evaporable getter layer further comprises a core layer substantially enclosed by a non-evaporable getter material.

13. The vacuum device in accordance with claim 1, further comprising multiple support structures.

14. The vacuum device in accordance with claim 1, wherein at least a portion of said support sidewalls have a non-evaporable getter material deposited thereon.

15. The vacuum device in accordance with claim 1, further comprising:

a cover; and a vacuum seal attached to said substrate and to said cover wherein said vacuum seal, said substrate, and said cover define an interspace region and provide a package enclosing said non-evaporable getter layer.

16. The vacuum device in accordance with claim 1, wherein said support structure includes a dielectric material selected from the group consisting of silicon oxide, silicon dioxide, silicon carbide, silicon nitride, aluminum oxide, boron nitride and combinations thereof.

17. The vacuum device in accordance with claim 1, wherein said non-evaporable getter layer includes a metal selected from the group consisting of molybdenum, titanium, thorium, and zirconium and combinations thereof.

18. The vacuum device in accordance with claim 1, wherein said non-evaporable getter layer has a thickness in the range from about 0.1 micrometer to about 1.0 micrometers.

19. The vacuum device in accordance with claim 1, wherein said non-evaporable getter layer has a thickness in the range of up to about 20.0 micrometers.

20. The vacuum device in accordance with claim 1, wherein said non-evaporable getter layer is comprised of a metal, selected from the group consisting of Zr—Al alloys, Zr—V alloys, Zr—V—Ti alloys, Zr—V—Fe alloys, and combinations thereof.

21. The vacuum device in accordance with claim 1, wherein said support structure further comprises a plurality of support structure lines formed from a non-evaporable getter material, and substantially parallel to each other, and said non-evaporable getter layer further comprises a plurality of non-evaporable getter lines substantially parallel to each other and at a predetermined angle to said plurality of support structure lines.

22. The vacuum device in accordance with claim 21, further comprising a plurality of second non-evaporable getter lines substantially parallel to each other and at a second predetermined angle to said plurality of said non-evaporable getter lines.

23. The vacuum device in accordance with claim 22, wherein said plurality of support structure lines, said non-evaporable getter lines and said second non-evaporable getter lines form a hexagonal array.

24. The vacuum device in accordance with claim 21, wherein said plurality of support structure lines, are substantially mutually orthogonal to said non-evaporable getter lines.

25. The vacuum device in accordance with claim 21, wherein said predetermined angle is between about 20 degrees and about 90 degrees.

26. The vacuum device in accordance with claim 1, further comprising an electronic device, operating at a pressure below atmospheric pressure, disposed on said substrate.

27. The vacuum device in accordance with claim 1, further comprising a mechanical device operating at a pressure below atmospheric pressure.

28. The vacuum device in accordance with claim 1, further comprising an optical device operating at a pressure below atmospheric pressure.

29. The vacuum device in accordance with claim 1, further comprising a micro-electro-mechanical system operating at a pressure below atmospheric pressure.

30. The vacuum device in accordance with claim 1, further comprising an electron emitter.

31. A storage device, comprising:

at least one vacuum device of claim 30; and a storage medium in close proximity to said at least one vacuum device, said storage medium having a storage area in one of a plurality of states to represent information stored in that storage area.

32. The storage device in accordance with claim 31, wherein said at least one vacuum device forms at least a portion on an electron lens element.

33. The vacuum device in accordance with claim 30; wherein said support structure and said non-evaporable getter layer form at least a portion of a lens element for said electron emitter.

34. A computer system, comprising:

a microprocessor;

an electronic device including at least one getter device of claim 1 coupled to said microprocessor; and memory coupled to said microprocessor, said microprocessor operable of executing instructions from said memory to transfer data between said memory and said electronic device.

35. The computer system in accordance with claim 34, wherein said electronic device is a storage device.

36. The computer system in accordance with claim 34, wherein said electronic device is a display device.

37. The computer system in accordance with claim 34, wherein said microprocessor further comprises a getter structure having:

a substrate;

a support structure having a support perimeter, said support structure disposed over said substrate; and a non-evaporable getter layer having an exposed surface area, said non-evaporable getter layer disposed over said support structure, and extending beyond said perimeter in at least one direction of said support structure forming a vacuum gap between said substrate and said non-evaporable getter layer, providing an increase in said exposed surface area.

38. The computer system in accordance with claim 34, wherein said memory further comprises a getter structure having:

a substrate;

a support structure having a support perimeter, said support structure disposed over said substrate; and a non-evaporable getter layer having an exposed surface area, said non-evaporable getter layer disposed over said support structure, and extending beyond said perimeter in at least one direction of said support structure forming a vacuum gap between said substrate and said non-evaporable getter layer, increasing said exposed surface area.

39. A vacuum device, comprising:

a substrate;

a first support structure having a support perimeter, said first support structure disposed over said substrate;

a non-evaporable getter (NEG) layer having an exposed surface area, said NEG, layer disposed over said first support structure;

a second support structure having a second perimeter, said second support structure disposed over said NEG layer; and a second NEG layer having a second exposed surface area, said second NEG layer disposed over said second support structure, wherein said NEG layer extends beyond said support perimeter forming a vacuum gap between said NEG layer and said substrate, and said second NEG layer extends beyond said second perimeter forming a second vacuum gap between said NEG layer and said second NEG layer.

40. A vacuum device, comprising:

a substrate;

a base non-evaporable getter layer disposed on a portion of said substrate a support structure having a support perimeter, said support structure disposed over said base non-evaporable getter layer; and a non-evaporable getter layer having an exposed surface area, said non-evaporable getter layer disposed over said support structure, and extending beyond said support perimeter in at least one direction of said support structure forming a vacuum gap between said substrate and said non-evaporable getter layer, increasing said exposed surface area.

* * * * *